United States Patent [19]

Ernst et al.

[11] Patent Number: 5,020,693

[45] Date of Patent: Jun. 4, 1991

[54] DOSAGE CONTROL FOR ADHESIVE DISPENSER

[75] Inventors: Richard J. Ernst; Sigismund Paul, both of Palatine; Frederick G. Sevald, Evanston; Marian Olma, Chicago, all of Ill.

[73] Assignee: Illinois Tool Works Inc., Glenview, Ill.

[21] Appl. No.: 373,424

[22] Filed: Jun. 30, 1989

[51] Int. Cl.[5] ..... B65D 88/54

[52] U.S. Cl. ..... 222/137; 222/309; 222/389

[58] Field of Search ..... 222/132, 136–137, 222/144.5, 309, 334, 325–327, 389, 608

[56] References Cited

U.S. PATENT DOCUMENTS

| | | | |
|---|---|---|---|
| 3,401,847 | 9/1968 | Downing | 222/334 X |
| 3,530,587 | 9/1970 | Anderson | 222/389 X |
| 3,890,922 | 6/1975 | Nordenholt | 222/334 X |
| 4,067,479 | 1/1978 | Moline | 222/94 |
| 4,376,498 | 3/1983 | Davis, Jr. | 222/326 |
| 4,511,283 | 4/1985 | Duval et al. | 404/107 |
| 4,690,310 | 9/1987 | Rasmussen | 222/309 |
| 4,826,050 | 5/1989 | Murphy et al. | 222/175 |

FOREIGN PATENT DOCUMENTS

| | | | |
|---|---|---|---|
| 3518780 | 11/1986 | Fed. Rep. of Germany | 222/389 |

*Primary Examiner*—Donald T. Hajec

*Attorney, Agent, or Firm*—Schwartz & Weinrieb

[57] ABSTRACT

A pneumatically actuatable dispenser for a two-part adhesive, as provided within a cartridge having two chambers and having a mixing nozzle mounted upto a first end, each chamber having a plunger accessible from a second end. A front frame holds the cartridge. A piston is arranged to be selectively driven within a cylinder in a forward or reverse direction. A pair of piston rods operate in tandem so as to drive the plungers toward the nozzle, when driven conjointly with the piston in the forward direction. A first valve, when actuated, delivers pressurized air from driving the piston in the forward direction. A second valve, when actuated, delivers pressurized air for driving the piston in the opposite direction. A third valve, when actuated while the first valve is actuated, vents pressurized air from the cylinder. A first control rod, which moves conjointly with the piston, and a second control rod may be selectively linked to each other for conjoint movement or unlinked from each other, by means of a linking lever and a cam. An actuator, which is adjustably positionable along the second control rod, actuates the third valve after conjoint movement of both control rods and the actuator, along with the piston, through means of a distance correlating to a controlled dose of the mixed parts of the adhesive. A fourth valve can be manually actuated so as to divert pressurized air, by means of a hose, to a nozzle for blowing water or debris from a hole which is to receive the adhesive.

20 Claims, 5 Drawing Sheets

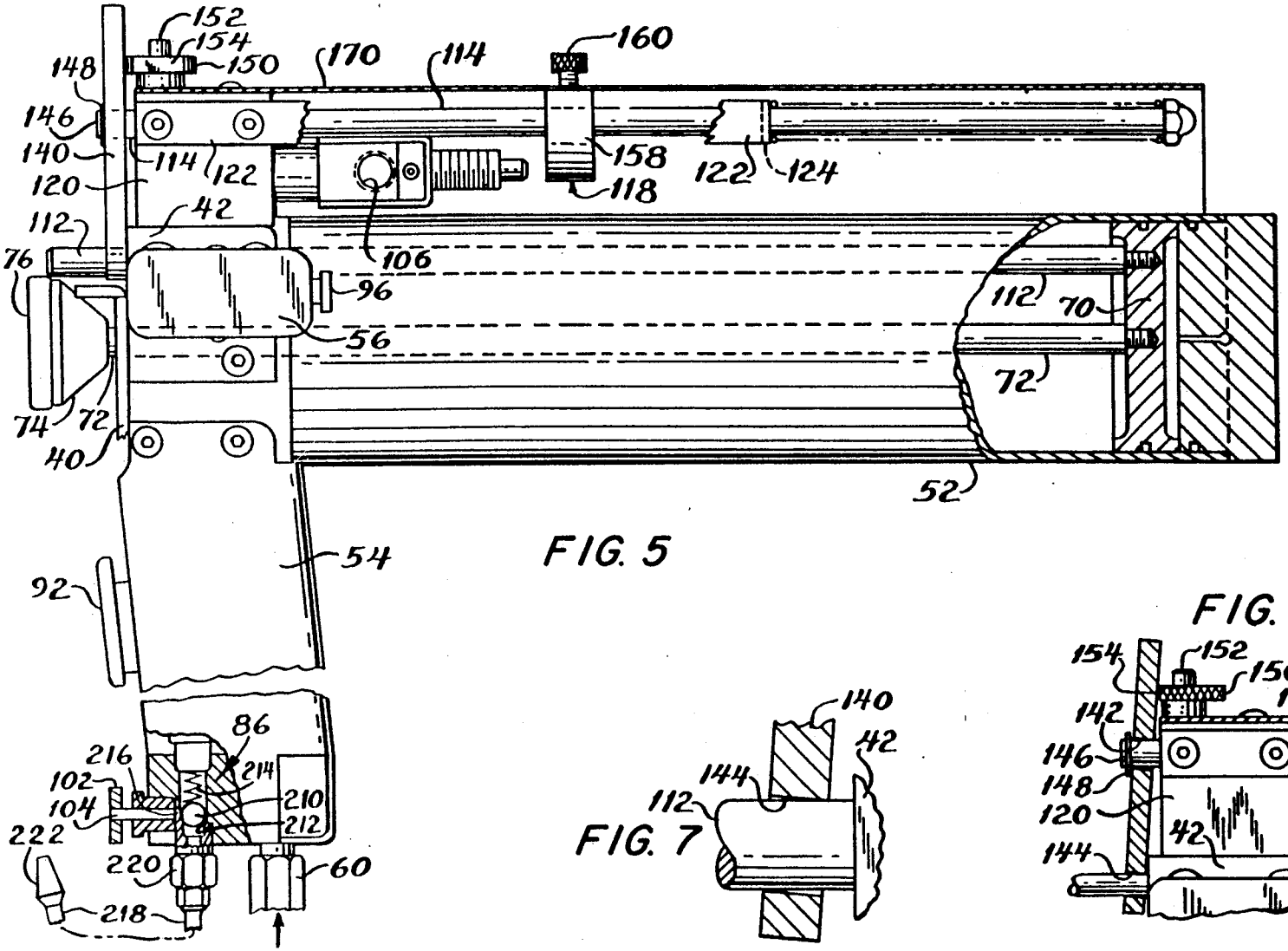
FIG. 5
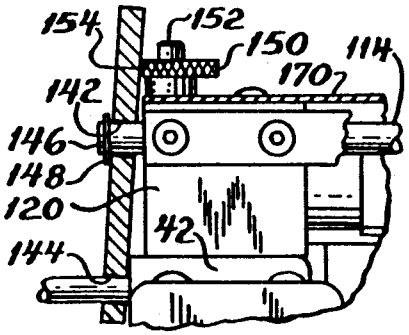
FIG. 6
FIG. 7

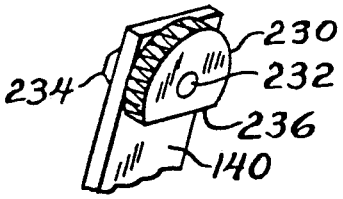
FIG. 13
FIG. 11
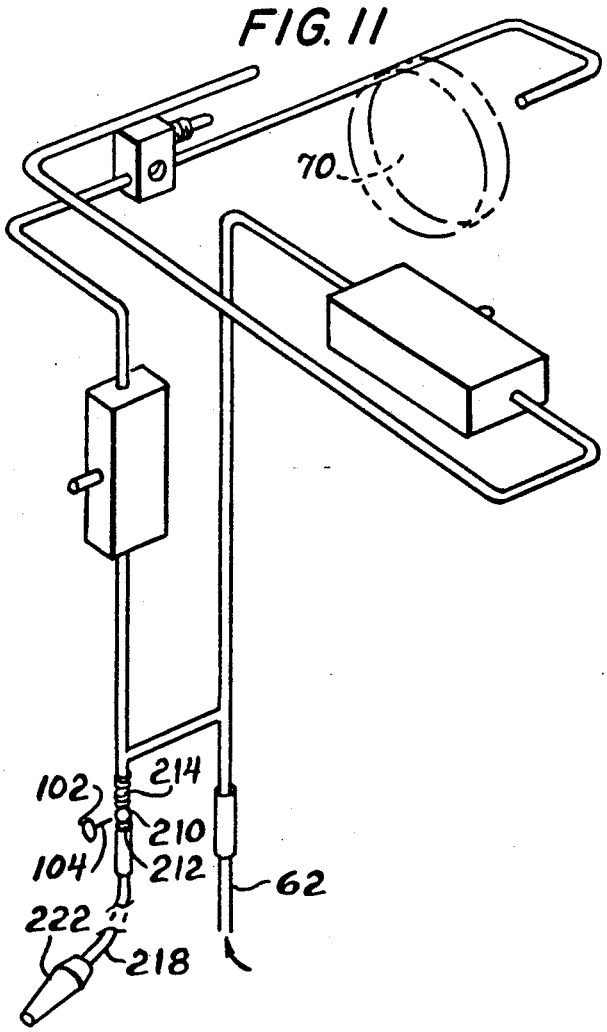
FIG. 14
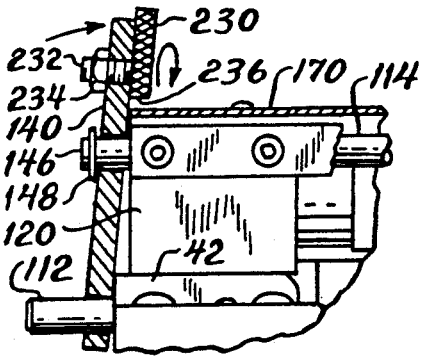
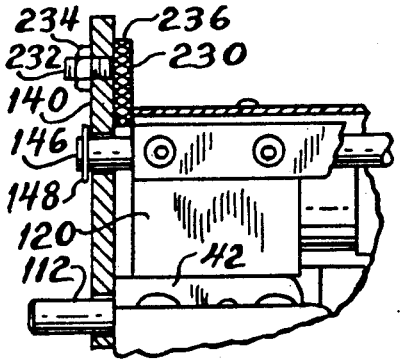
FIG. 15
FIG. 12
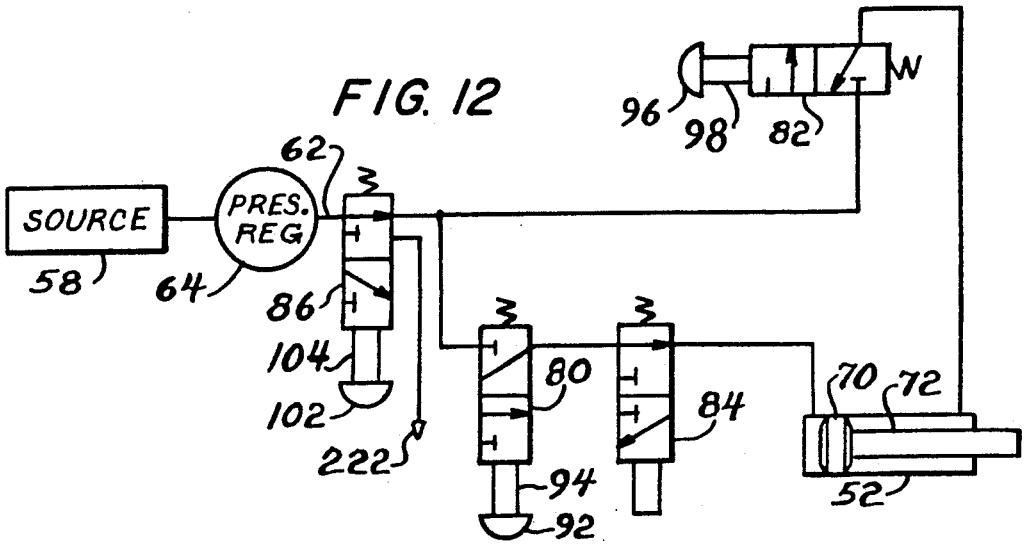

DOSAGE CONTROL FOR ADHESIVE DISPENSER

TECHNICAL FIELD OF THE INVENTION

This invention pertains to an improved, pneumatically-actuated dispenser for an adhesive, such as, for example, a two-part epoxy adhesive. This invention also provides dosage control for the adhesive dispenser.

BACKGROUND OF THE INVENTION

Two-part adhesives, such as, for example, two-part epoxy adhesives, are used widely, in large doses at construction sites and elsewhere, particularly but not exclusively in order to set studs, anchors, and other hardware into holes bored or otherwise formed within concrete or masonry structure. Such adhesives are commercially available in two-chamber cartridges, which fit into various manually-actuated or pneumatically-actuated dispensers. A commercial source for such adhesives in such cartridges, for such manually-actuated dispensers, and for such pneumatically-actuated dispensers is ITW Ramset/Red Head (a division of Illinois Tool Works Inc.) of Wood Dale, Ill.

Even at a construction site where large doses of such adhesives are used, a single dose may not use the entire contents of such a cartridge, which may contain enough of such adhesive, or of each part of such adhesive, to provide two, three, or more doses. It is known to provide a visible scale, upon an exposed surface of such a cartridge, as a way to measure each dose. When using a manually actuated or pneumatically actuated dispenser, it has been necessary heretofore for the user to visually estimate, as by means of the movement of a rod of the dispenser vis-a-vis such a scale if provided, when each dose has been dispensed. Commonly, moreover, it has been necessary for the user to estimate when a sufficient dose has been injected into a hole.

Consequentially, there has been a need, to which this invention is addressed, for a better way to achieve dosage control with a pneumatically-actuated dispenser for an adhesive, particularly but not exclusively a two-part adhesive, such as, for example, a two-part epoxy adhesive.

SUMMARY OF THE INVENTION

This invention provides an improved, pneumatically actuatable dispenser for an adhesive, as provided within a cartridge of a known type. Such a cartridge has a chamber containing the adhesive, a nozzle mounted to a first end of the cartridge, and a plunger accessible from a second end of the cartridge and displaceable through the chamber, toward the nozzle, so as to force the adhesive into the nozzle, through which the adhesive is ejected, such as, for example, into a hole bored or formed otherwise formed within concrete or masonry structure.

Although the improved dispenser provided by means of this invention is useful for a single-part adhesive, as provided within such a cartridge having a single chamber, or for a several-part adhesive, as provided within such a cartridge having several chambers, the improved dispenser provided by means of this invention has particular utility for a two-part adhesive, as provided within such a cartridge having two chambers. Within such a cartridge having two chambers, each chamber contains one of the two parts of the adhesive, and the cartridge has a mixing nozzle, which is mounted upon a first end of the cartridge, and which is arranged to receive one of the parts of the adhesive from each chamber and to mix such parts of the adhesive together. Moreover, each chamber has a plunger, which is accessible from a second end of the cartridge, and which is displaceable through such chamber, toward the nozzle, within which the parts of the adhesive are mixed, and through which the mixed parts of the adhesive are ejected.

Generally, the improved dispenser provided by means of this invention comprises a frame, which is adapted to hold such a cartridge, and a pneumatic mechanism, which is connectable to a source of pressurized air, such as, for example, an air cylinder or an air compressor, and which is attached to the frame so as to support the frame with such a cartridge held within the frame.

The pneumatic mechanism comprises a pneumatic cylinder, which is attached to the frame, and a pneumatic piston, which is arranged so as to be pneumatically driven within the pneumatic cylinder, selectively in a forward direction or in a reverse direction. The pneumatic piston may thus be described as double-acting.

The pneumatic mechanism comprises a piston rod for each cartridge chamber. If one piston rod is used for such a cartridge having a single chamber, the piston rod is arranged so as to drive the plunger of the cartridge toward the nozzle of the cartridge when the pneumatic piston is driven in a forward direction and to withdraw from the plunger when the pneumatic piston is driven in a reverse direction. If a pair of piston rods are used for such a cartridge having two chambers, each piston rod is arranged so as to drive the plunger of a respective one of the chambers toward the nozzle of the cartridge when the pneumatic piston is driven in a forward direction and to withdraw from the same plunger when the pneumatic piston is driven in a reverse direction.

The pneumatic mechanism comprises several pneumatic valves, namely a first manually actuatable valve, a second manually actuatable valve, and a third mechanically actuatable valve. The first valve is arranged, when actuated manually with the pneumatic mechanism connected to the source of pressurized air, so as to deliver pressurized air from the source to the pneumatic cylinder so as to drive the pneumatic piston in the forward direction. The second valve is arranged, when actuated manually with the pneumatic mechanism connected to the source of pressurized air, so as to deliver pressurized air from the source to the pneumatic cylinder so as to drive the pneumatic piston in the reverse direction. The first and second valves are similar to valves previously used upon adhesive dispensers as known heretofore. The third valve, which is novel in an adhesive dispenser, is arranged, when actuated mechanically (in a manner to be later described) while the first valve is connected to a source of pressurized air and actuated, so as to block pressurized air from flowing from the first valve into the pneumatic cylinder and to simultaneously to vent pressurized air, as previously delivered by means of the first valve, from the pneumatic cylinder to ambient atmosphere.

Novel means are provided for limiting joint movement of the pneumatic piston and the piston rod, or piston rods, in the forward direction so as to enable such dispenser to dispense an adjustably controlled dose of an adhesive, or of the mixed parts of an adhesive, from such a cartridge held within the frame. Such means are adjustable by means of the user.

In a preferred embodiment, the novel means mentioned in the preceding paragraph are provided by means of a first control rod, a second control rod, means operable manually and selectively by means of a user for certain purposes described below, and an actuator for the third valve. The first control rod, which is similar to rods used upon adhesive dispensers as known heretofore, is arranged so as to be conjointly driven with the pneumatic piston, and along an exterior surface of such a cartridge held by means of the frame, without interfering with the cartridge. The second control rod is arranged so as to be selectively linked to or unlinked from the first control rod so as to move conjointly with the first control rod, in parallel relation with respect to the first control rod, when linked to the first rod, and so as to be independently movable when unlinked from the first control rod whereby the second control rod can return to a home position. The last-mentioned means are operable manually and selectively by means of a user to link the second control rod to the first control rod, at any position within a range of possible positions along the first control rod, or to unlink the second control rod from the first control rod.

Preferably, the means described in the preceding sentence comprise a linking lever, which is attached to one end of the second control rod so as to retain the linking lever upon the end of the second control rod but to permit a limited range of pivotal movement of the linking lever upon the end of the second control rod. The linking lever has an aperture, through which the first control rod extends with a loose fit allowing the first control rod to pass freely through the aperture except when pivotal movement of the linking lever causes the linking lever to frictionally to engage the first control rod. Coacting means are provided, namely means for biasing the second control rod in the reverse direction and means manually operable by means of a user so as to position the linking lever selectively in a pivotal position permitting the first control rod to pass freely through the aperture or in a pivotal position causing the linking lever to frictionally to engage the first control rod as mentioned.

Preferably, the means manually operable by means of a user so as to position the linking lever comprises a cam, which is operatively mounted, more preferably upon the pneumatic cylinder or less preferably upon the linking lever, and which is arranged to be manually adjusted between a condition wherein the cam engages and is interposed between the linking lever and adjacent structure so as to position the linking lever in the pivotal position permitting the first control rod to pass freely through the aperture and a condition wherein the cam permits the means for biasing the second control rod in the rearward direction to pivot the linking lever, by means of the second control rod, to a pivotal position causing the linking lever to frictionally engage the first control rod as mentioned.

The actuator mentioned above is adjustably positionable along the second control rod, at any position within a range of possible positions along the second control rod, for conjoint movement with the second control rod. In addition, the actuator is arranged so as to actuate the third valve (so as to block pressurized air from flowing from the first valve into the pneumatic cylinder and simultaneously to vent pressurized air, as delivered previously by means of the first valve, from the pneumatic cylinder) upon conjoint movement of the first control rod, the second control rod, and the actuator from respective dose-initiating positions relative to the pneumatic cylinder to respective dose-concluding positions relative thereto. When the first control rod, the second control rod, and the actuator are disposed at their dose-initiating positions, the piston rod, or piston rods, can begin to drive the plunger, or plungers, of such a cartridge held by means of the frame toward the nozzle of the cartridge. When the first control rod, the second control rod, and the actuator are disposed at their dose-concluding positions, the plunger, or plungers, of such a cartridge has, or have, been displaced by through means of a distance correlating to a controlled dose of adhesive, or of the mixed parts of an adhesive, from the cartridge.

The actuator mentioned above can be adjustably positioned along the second control rod so as to enable the dispenser, when the second control rod is linked to the first control rod, to dispense a controlled dosage of an adhesive, or of the mixed parts of an adhesive, from such a cartridge held by means of the frame with such dose being less than the full contents of such cartridge, such as, for example, such dose being one-third of such contents.

Because of this invention, there is no need for a user to visually judge when each dose has been ejected or to estimate when a sufficient dose has been injected into a hole. Such visual judgments and such estimates can oftentimes be impossible because of application conditions.

Moreover, the pneumatic mechanism may comprise a manually actuatable fourth valve, which is arranged, when actuated with the pneumatic mechanism connected to the source of pressurized air, to divert pressurized air entering the pneumatic mechanism, along with a hose connected to the fourth valve and, preferably, a nozzle connected to the hose. The fourth valve and the hose, either with or without the nozzle connected to the hose, can be advantageously used to blow water, debris, or both from a hole bored or otherwise formed within a concrete or masonry structure, just before an adhesive is dispensed into the hole.

A similar arrangement of such a valve and a hose, either with or without a nozzle connected to the hose, can be advantageously used, in like manner, within any pneumatically actuatable dispenser for an adhesive, as provided within such a cartridge, if the dispenser comprises a frame, which is adapted to hold the cartridge, and a pneumatic mechanism, which is connectable to a source of pressurized air, which is attached to the frame, and which is operable so as to dispense an adhesive from such a cartridge held by means of the frame.

BRIEF DESCRIPTION OF THE DRAWINGS

These and other objects, features, and advantages of this invention will become evident from the following description of a preferred embodiment of this invention, with reference to the accompanying drawings, in which like reference characters designate like or corresponding parts throughout the several views, and wherein:

FIG. 5 is a partly fragmentary, elevational view taken from one side, partly in cross-section, so as to show certain details of the adhesive dispenser, a front frame shown in FIG. 1 having been omitted from FIG. 5.

FIG. 6 is a fragmentary detail of certain elements shown in FIG. 5, but with a linking lever shown in cross-section and in a changed position, and with a cam shown in a changed position.

FIG. 7 is a greatly enlarged, fragmentary detail of the linking lever and a first control rod, with which the linking lever coacts.

FIG. 11 is a conceptual layout of pneumatic controls and pneumatic lines, as used in connection with the adhesive dispenser of FIG. 1.

FIG. 12 is a circuit diagram of the pneumatic controls and pneumatic lines, as shown in FIG. 11.

FIG. 13 is a fragmentary, perspective detail of one end of the link and a cam substitutable for the cam shown in accordance with other views, described above, in an alternative embodiment of this invention.

FIGS. 14 and 15 are fragmentary details similar to FIG. 6, but with the cam shown in FIG. 13, and wherein the linking levers and the cam are shown in different positions in FIGS. 14 and 15 respectively.

DETAILED DESCRIPTION OF THE PREFERRED EMBODIMENT

Figure 8:
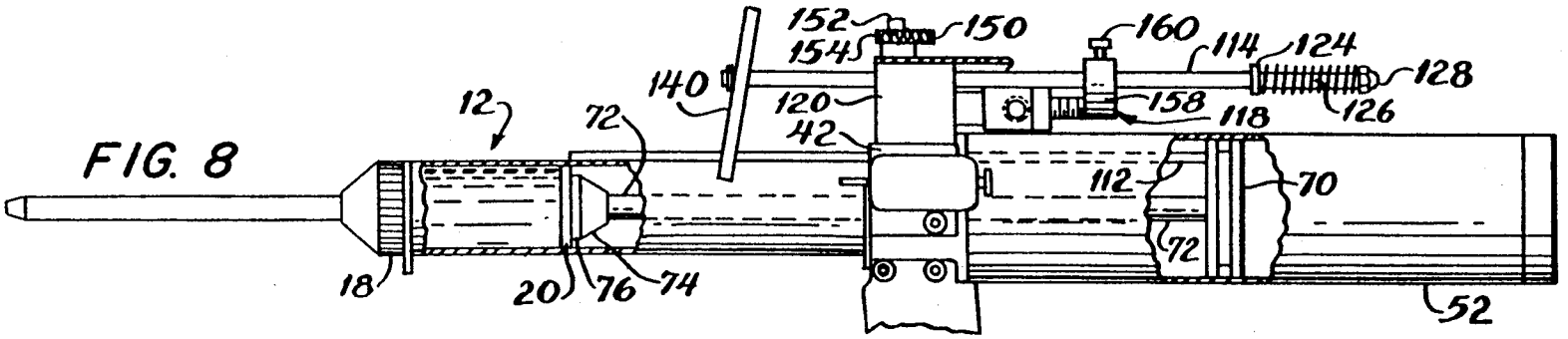
FIGS. 8, 9, and 10 are partly fragmentary, elevational views of the adhesive injector, with certain elements shown in different positions in phantom and full lines respectively so as to illustrate sequential operations of the adhesive dispenser.
Figure 9:
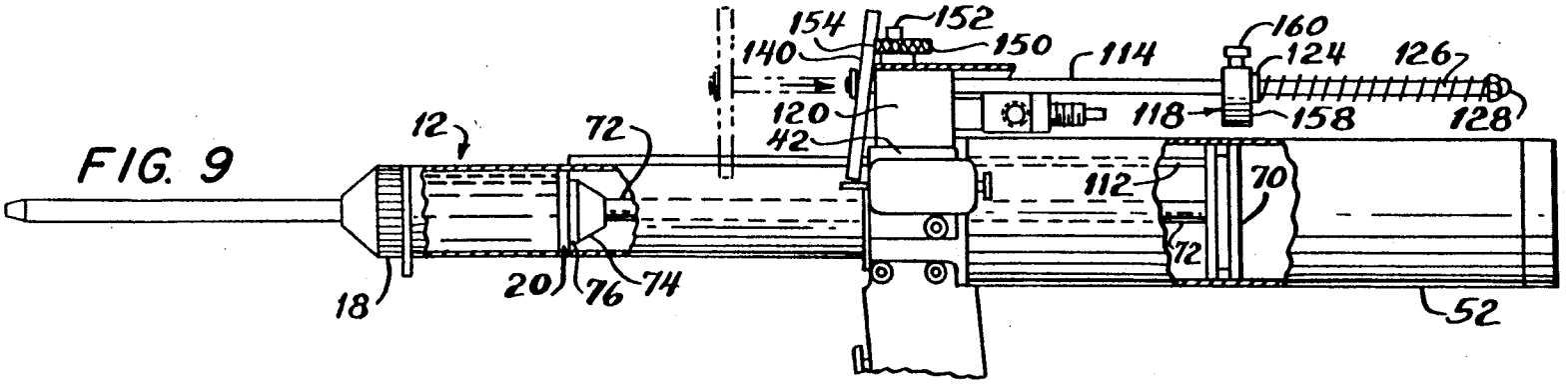
Figure 10:
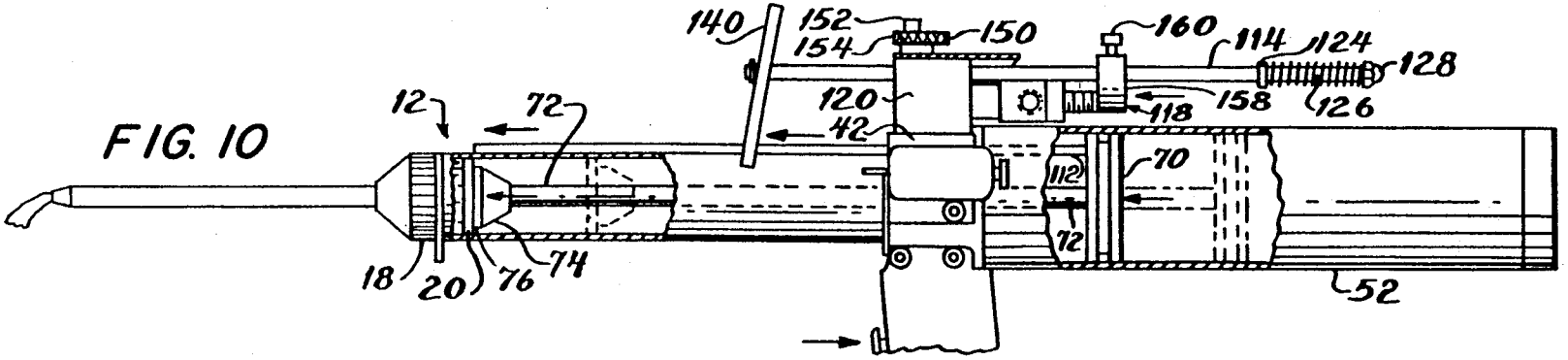

As shown in FIGS. 1 through 12, a pneumatically actuated dispenser 10 for a two-part adhesive, such as for example, a two-part epoxy adhesive, as provided within a cartridge 12, constitutes a preferred embodiment of this invention. The cartridge 12, which appears in FIG. 1 and also in FIGS. 8, 9, and 10, is an example of cartridges with which the dispenser 10 is useful. The cartridge 12 has two chambers 14, which are tubular with circular cross-sections, and a replaceable mixing nozzle 16, which is attached at a first or front end of the cartridge 12 by means of a threaded connector 18, and which has an elongate tip, as shown in FIGS. 8, 9, and 10. Each chamber 14 contains one part of the adhesive, typically but not necessarily in gel, paste, semi-liquid, or high viscosity liquid form, and has a plunger 20 (one shown; see FIGS. 8 through 10) which seals each adhesive part within its cartridge chamber, and which is accessible from a second or back end of the cartridge 12, and which is displaceable through such chamber 14, toward the nozzle 16. The nozzle 16 is arranged so as to receive one part of the adhesive from each chamber 14, to mix the parts of the adhesive, and to inject the mixed parts of the adhesive, into a hole (not shown) bored or otherwise formed within a concrete or masonry structure, just after water and debris have been blown from the hole in a manner to be later described. The adhesive may thus be used to set a stud, anchor, or other hardware (not shown) within the hole. The cartridge 12 is formed with a longitudinal valley 22, which extends along its upper, exterior surface. Such cartridges containing available two-part epoxy adhesives are commercially from ITW Ramset/Red Head (a division of Illinois Tool Works Inc.) of Wood Dale, Ill.

Generally, the dispenser 10 comprises a front frame, which is adapted to hold a cartridge exemplified by means of the cartridge 12, and a pneumatic mechanism, which is attached to the front frame so as to support the front frame with the cartridge held by within the front frame.

Figures 1, 2:
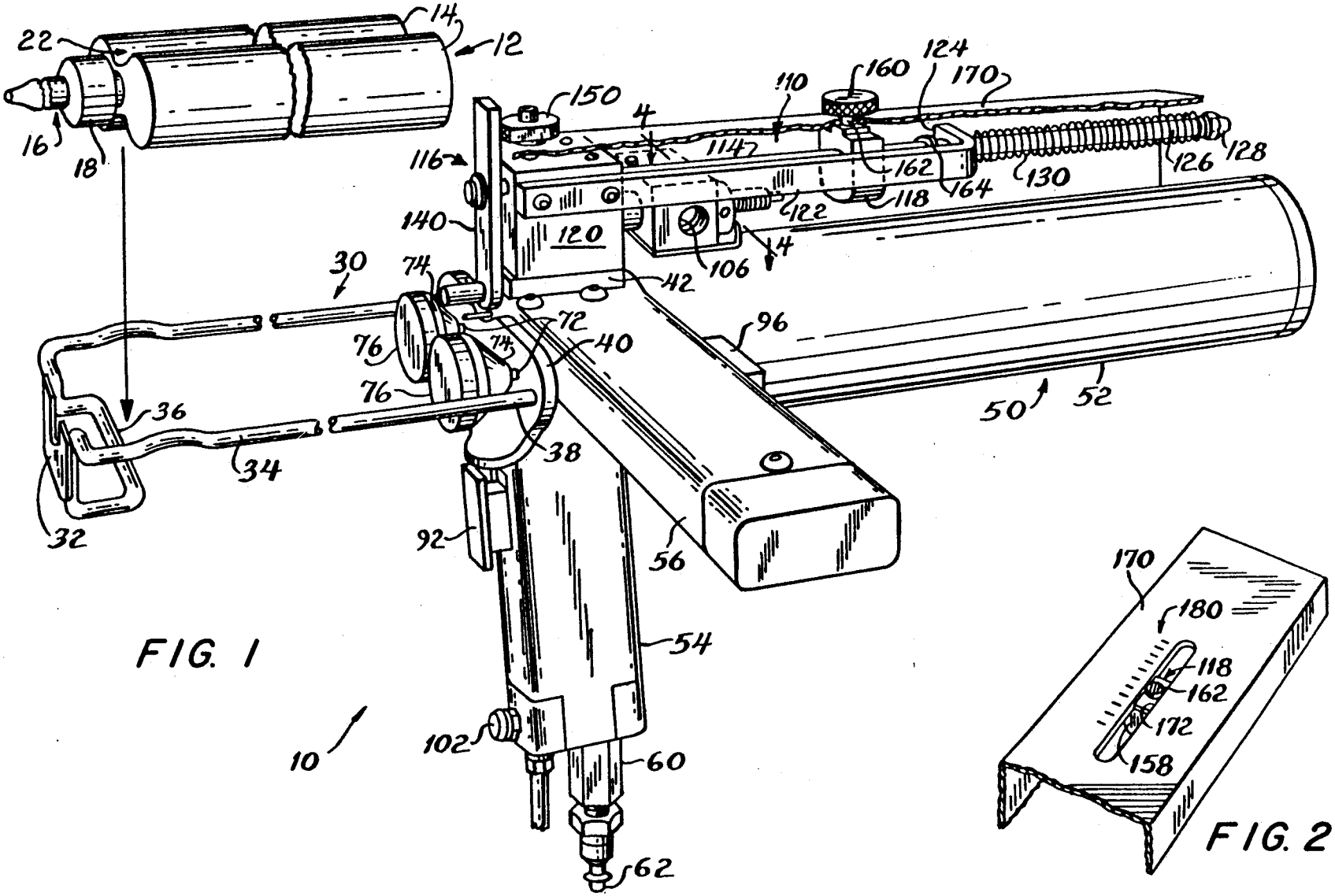
FIG. 1 is a partly fragmentary, partly exploded, perspective view of an improved, pneumatically-actuated, adhesive dispenser constituting a preferred embodiment of this invention, along with a two-chamber cartridge containing a two-part adhesive.
FIG. 2 is a partly fragmentary, perspective view of a cover used in the adhesive dispenser of FIG. 1, an adjustable actuator used therein appearing beneath a slot defined within the cover, which is shown as bearing visible indicia.
Figure 3:
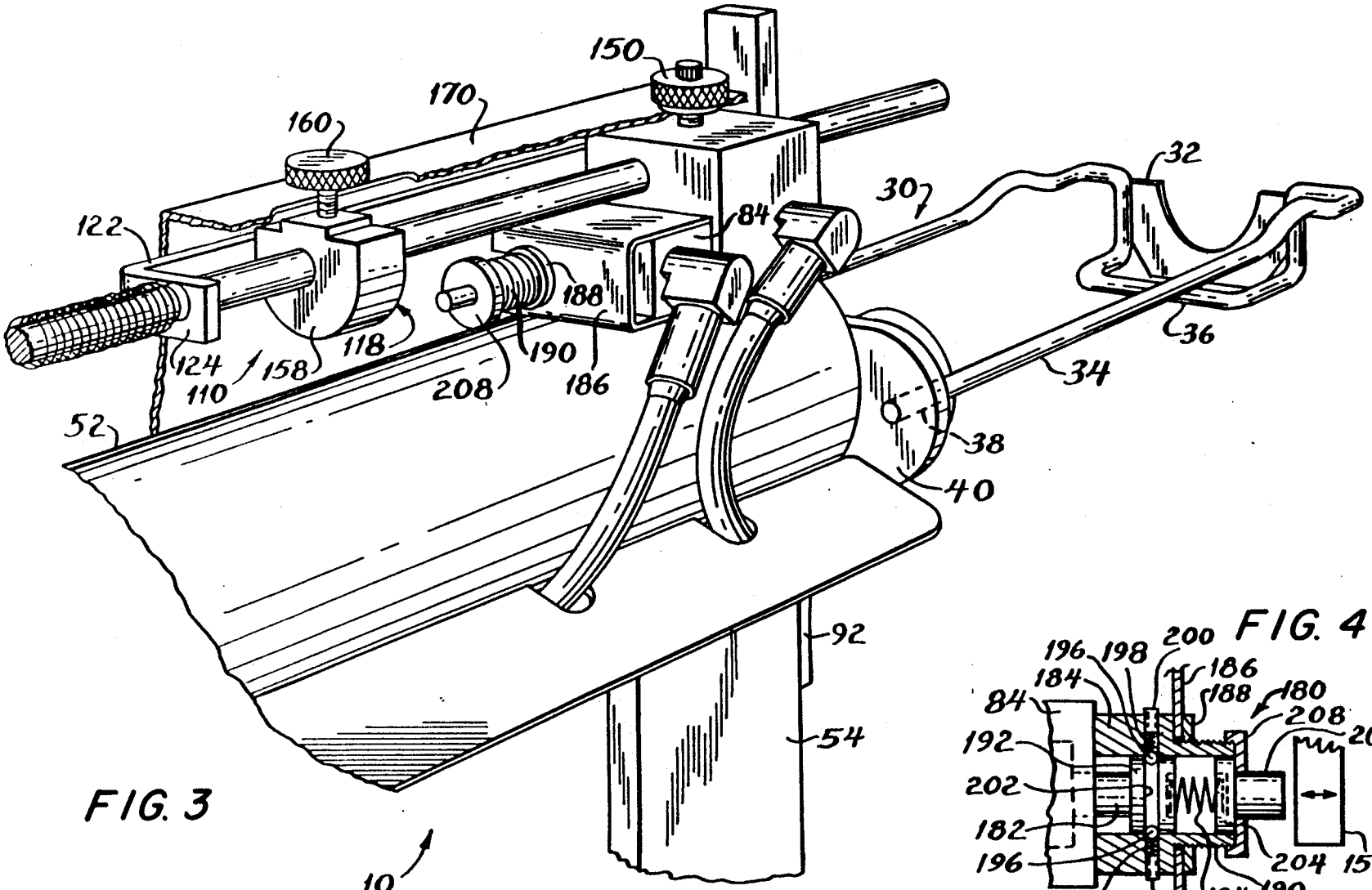
FIG. 3 is a partly fragmentary, perspective view of the adhesive dispenser of to FIG. 1, FIG. 3 being taken from a different vantage point.

As shown in FIGS. 1 and 3, the front frame 30 comprises a cradle 32, which is fabricated from sheet steel, and which fits under and partially around the nozzle 16, so as to limit axial movement of the connector 18 when the connector 18 is threaded onto the cartridge 12, and a wire bracket 34, which is fabricated from steel wire, and which has a bight 36 which is adapted to fit under a front portion of a cartridge exemplified by means of the cartridge 12. The wire bracket 34, which is welded to the cradle 32 at spaced locations near the bight 36, is secured at its opposite ends 38 to the pneumatic mechanism, by means of a mounting plate 40, which is integrally mounted to a front surface of a lower mounting block 42.

The pneumatic mechanism 50 comprises a pneumatic cylinder 52, a handle 54 extending downwardly from the lower mounting block 42, and a handle 56 extending laterally from the lower mounting block 42, and is connectable to a source 58 of pressurized air, under regulated pressure, such as, for example, an air compressor, which is preferred, or an air cylinder. The source 58 is represented diagrammatically in FIG. 12. The pneumatic mechanism 50 is connectable to the source 58 of pressurized air, by means of a conventional fitting 60, which is provided at a lower end of the downwardly extending handle 54, and a flexible pneumatic line 62, which is shown fragmentarily in FIG. 1, and diagrammatically in FIGS. 11 and 12, and a pressure regulator 64, which is shown diagrammatically in FIG. 12.

A double-acting pneumatic piston 70 (see FIGS. 8 through 12) is arranged, in a conventional manner, so as to be pneumatically driven in a selective manner within the pneumatic cylinder 52, either in the forward direction or in the reverse direction. Two piston rods 72 are provided, which operate in tandem, one for each chamber of a cartridge such as the cartridge 12. Each piston rod 72 extends through a suitably sealed aperture defined within a front end of the pneumatic cylinder 52, and through suitable apertures defined within the lower mounting block 42 and within the mounting plate 40, and is provided at its distal end with an enlarged boss 74, upon which is mounted a plunger-engaging element 76 made of synthetic rubber an equivalent material. Each piston rod 72 is arranged, by means of the plunger-engaging element 76 mounted upon the enlarged boss 74 of the distal end of such piston rod 72, to drive the plunger 20 of a respective one of the chambers of a cartridge exemplified by means of the cartridge 12, as held by the front frame 30, when the pneumatic piston 70 is driven in the forward direction and to withdraw from the plunger when the pneumatic piston 70 is driven oppositely, that is, in the reverse direction. The enlarged bosses 74 and the plunger-engaging elements 76 conform approximately, in outer diameter, to the plungers of such a cartridge, such as, for example, the plungers 20.

The pneumatic mechanism 50 comprises several pneumatic valves, namely a first manually actuatable valve 80, a second manually actuatable valve 82, a third mechanically actuatable valve 84, and a fourth manually actuatable valve 86, each as represented diagrammatically within FIGS. 11 and 12. The first valve 80 is mounted in the downwardly extending handle 54, so as to be manually actuatable an external button 92 carried upon a stem 94 (see FIG. 12) of the first valve 80. The second valve 82 is mounted within the laterally extending handle 56 so as to be manually actuatable by means of an external button 96 carried upon a stem 98 (see FIG. 12) of the second valve 82. The third valve 84 is mounted upon the pneumatic cylinder 52 so as to be mechanically actuatable in a manner to be later described. The fourth valve 86 is mounted within the downwardly extending handle 54, beneath the first valve 80, so as to be manually actuatable by means of an external button 102 carried upon a stem 104 (see FIG. 12) of the fourth valve 86.

The first valve 80 is arranged, when actuated with the pneumatic mechanism 50 connected to the source 58 of pressurized air, to deliver pressurized air from the source 58 to the pneumatic cylinder 52 so as to drive the pneumatic piston 70 in the forward direction. The second valve 82 is arranged, when actuated with the pneumatic mechanism 50 connected to the source 58 of pressurized air, to deliver pressurized air from the source 58 to the pneumatic cylinder 52 so as to drive the pneumatic piston 70 in the reverse direction. Pneumatic lines connected to and from the first valve 80 and pneumatic lines connected to and from the second valve 82 are represented diagrammatically in FIGS. 11 and 12. If the first valve 80 and the second valve 82 should be simultaneously actuated with the pneumatic mechanism 50 connected to the source of pressurized air, the pneumatic piston 70 would stall and would not be pneumatically driven in either direction.

The third valve 84 is arranged, when actuated while the first valve 80 is actuated, to block pressurized air from flowing from the first valve 80 into the pneumatic cylinder 52 and simultaneously to vent pressurized air, as delivered previously by means of the first valve 80, from the pneumatic cylinder 52, through the third valve 84 and through a port 106 (see FIG. 1) to ambient atmosphere, whereby the pneumatic piston 70 tends to be immediately arrested. If each part of an adhesive provided within a cartridge exemplified by means of the cartridge 12 is provided in gel, paste, semi-liquid, or high viscosity liquid form, as mentioned above, inertial movement of the pneumatic piston 70 tends to be very insignificant.

Means 110 are provided for limiting conjoint movement of the pneumatic piston 70 and the piston rods 72 in the forward direction, so as to enable the dispenser 10 to dispense an adjustably controlled dose of the mixed parts of an adhesive from a cartridge exemplified by means of the cartridge 12, as held by means of the front frame 30. The means 110, which are adjustable by means of a user, are provided by means of a first control rod 112, a second control rod 114, means 116 operable manually and selectively by means of a user for certain purposes described below, and an actuator 118 for the third valve 84. See FIGS. 1 and 8, 9, and 10.

The first control rod 112 extends through a suitably sealed aperture defined within the front end of the pneumatic cylinder 52, and through suitable apertures defined within the lower mounting block 42 and within the mounting plate 40, and is arranged so as to be conjointly driven with the pneumatic piston 70, along an upper, exterior surface of a cartridge exemplified by means of the cartridge 12, as held by means of the front frame 30, and along a longitudinal valley exemplified by means of the valley 22 of the cartridge 12. If the cartridge bears a visible scale (not shown) upon its upper, exterior surface, a user can visually judge, by means of movement of the first control rod 112 with respect to the scale, movement of the pneumatic piston 70, conjointly with the first control rod 112, as has been achieved within adhesive dispensers as known heretofore.

The second control rod 114 is arranged to be selectively linked to or unlinked from the first control rod 112 so as to move conjointly with the first control rod 112, in parallel relation with respect to the first control rod 112, when linked to the first control rod 112, and so as to be independently movable when unlinked from the first control rod 112.

The second control rod 114 is mounted for axial movement, in the forward direction and in the reverse direction, by means of an upper mounting block 120, which is integrally mounted upon the lower mounting block 42, and which has a suitable aperture for accommodating the second control rod 114, and by means of a mounting strap 122 which extends rearwardly from the upper mounting block 120, and which has a bent end 124 having a suitable aperture for accommodating the second control rod 114. A rearmost end 126 of the second control rod 114 is threaded. A cap nut 128 is threaded onto the threaded end 126. A coiled spring 130, which is deployed around the second control rod 114, between the bent end 124 of the mounting strap 122 and the cap nut 128, biases the second control rod 114 in the rearward direction.

The means 116 mentioned above as being selectively manually operable by means of a user prevents the second control rod 114, as biased by means of the coiled spring 130, from being pulled through the upper mounting block 120.

Such means 116 comprise a linking lever 140 having an aperture 142, through which the first control rod 112 passes with sufficient clearance so as to permit the linking lever 140 to pivot from a position disposed at a right angle with respect to the first control rod 112 through an angle as large as approximately 10° relative to the first control rod 112, and an aperture 144, through which the second control rod 114 passes with sufficient clearance so as to permit the linking lever 140 to pivot through a similar angle relative to the second control rod 114, that is, through an angle as large as approximately 10° relative to the second control rod 114. The adjacent end 146 of the second control rod 114 is fitted with a retaining clip 148, which prevents the second control rod 114, as biased by means of the coil spring 130, from being pulled through the aperture 144 defined within the linking lever 140.

The upper mounting block 120 is laterally offset with respect to the lower mounting block 42, as shown in FIGS. 1, 5, and 6. Such means 116 also comprise a cam 150, which is mounted upon the upper mounting block 120, by means of a vertical pin 152, for free rotation in either rotational sense about a vertical axis defined by the vertical pin 152, and which is cylindrical, except for a flat surface 154 truncating its cylindrical periphery, and except for knurling impressed upon its cylindrical periphery. The cam 150 engages and is interposed between upper portions of the linking lever 140 and adjacent structure provided by means of the upper mounting block 120, so as to position upper portions of the linking lever 140 away from the upper mounting block 120 when lower portions of the linking lever 140 bear against the lower mounting block 42, unless the cam 150 is rotated so that the flat surface 154 faces and engages the linking lever 140. If the cam 150 is rotated so that the flat surface 154 faces and engages the linking lever 140, the linking lever 140 is permitted to pivot, as biased by means of the coiled spring 130 biasing the second control rod 114, from a position disposed at a right angle with respect to the first control rod 112 through the aforesaid angles (as large as approximately 10°) relative to the first control rod 112 and the second control rod 114 respectively. When the linking lever 140 is pivoted to the aforenated angled positions relative to the first control rod 112 and the second control rod 114 respectively, frictional engagement occurs between the linking lever 140 and the first control rod 112, at diametrically two points located respectively at opposite upper and lower portions of the margins of the aperture 142, and causes the linking lever 140 to link the second control rod 114 to the first control rod 112. Similar engagement can but does not have to occur between the linking lever 140 and the second control rod 114 at diametrically opposite upper and lower portions of the margins of the aperture 144. The retaining clip 148 causes the second control rod 114 to move conjointly with the linking lever 140 in a forward direction. However, when the linking lever 140 is disposed at right angles relative to the first control rod 112 and the second control rod 114 respectively, the first control rod 112 and the second control rod 114 are unlinked from each other, as occurs when the linking lever 140 is at a home position wherein the cam 152 (but not the flat surface 154) engages the linking lever 140 or when the linking lever 140 (at or away from the home position) is manually actuated.

The actuator 118 comprises a block 158 having a suitable aperture, through which the second control rod 114 passes, and a thumb screw 160, which has a threaded shank 162. The thumb screw 160 can be manually loosened, so as to permit the actuator 118 to be adjustably positioned along the second control rod 114, and can be manually tightened, so as to secure the actuator 118 at a selected position along the second control rod 114. The actuator 118 can thus be adjustably positioned within a range of possible positions along the second control rod 114. The range is defined by means of a retaining clip 164, which is mounted within an annular groove defined within the second control rod 114, and by means of the third valve 84. See FIG. 1. The actuator 118 is arranged to actuate the third valve 84 in a manner described below (so as to block pressurized air from flowing from the first valve 80 into the pneumatic cylinder 52 and simultaneously to vent pressurized air, as delivered previously by means of the first valve 80, from the pneumatic cylinder 52) upon conjoint movement of the first control rod 112, the second control rod 114, and the actuator 118 from respective dose-initiating positions relative to the pneumatic cylinder 52 (see for example, FIG. 9) where the piston rod 72 can begin (by means of the enlarged bosses 74 and the plunger-engaging elements 76) to drive the plungers of a cartridge exemplified by means of the cartridge 12, as held by means of the front frame 30, toward the nozzle of the cartridge and to respective dose-concluding positions relative to the pneumatic cylinder 52 (see, for example, FIG. 10) where the plungers of the cartridge have been displaced through means of a distance correlating to a controlled dose of the mixed parts of an adhesive from the cartridge.

After a dose of the mixed parts of adhesive from a cartridge exemplified by means of the cartridge 12 has been dispensed by means of the dispenser 10 (see, for example, FIG. 8) the linking lever 140 must be manually pivoted so as to assume a right angle position relative to the first control rod 112 and the second control rod 114 respectively (see, for example, FIG. 9 wherein the linking lever 140 is shown, in phantom lines, at right angles relative thereto) whereupon the coiled spring 130 can pull the linking lever 140, by means of the second control rod 114, in the rearward direction until lower portions of the linking lever 140 engage the lower mounting block 42, at the home position noted above. If another next dose is to be dispensed from the same cartridge, the cam 150 must remain rotated (or be rotated again) so that the flat surface 154 faces and engages the linking lever 140, whereby the linking lever 140 again links the first control rod 112 and the second control rod 114 to each other.

A cover 170, which has an elongate slot 172 for accommodating the threaded shank 162 of the thumb screw 160, and which has an aperture for accommodating the vertical pin 152 mounting the cam 150, is bolted onto the upper mounting block 120. The cover 170 covers the third valve 84, as a precaution against accidental or deliberate actuation of the third valve 84 by means of a user during injection of a dose of the adhesive, and covers the second control rod 114, the upper mounting block 120, the mounting strap 122, and the coiled spring 130, as a precaution against the user pinching his or her fingers. As shown in FIG. 2, the cover 170 is provided with visible indicia 180, to which a user can refer when positioning the actuator 118, by means of the thumb screw 160, along the second control rod 114.

Figure 4:
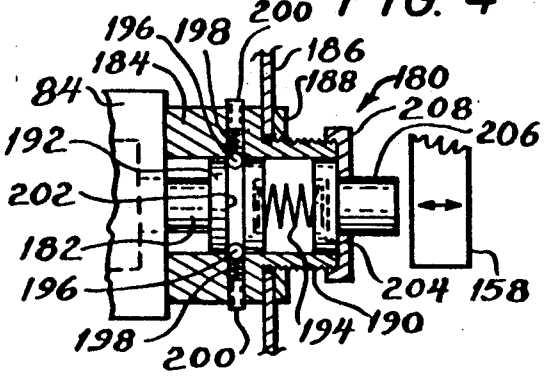
FIG. 4 is a fragmentary view taken substantially in axial cross-section so as to show an actuator for a valve used within the adhesive dispenser of FIG. 1.

As shown in FIG. 4, means 180 are provided for ensuring rapid actuation of the third valve 84 by means of the actuator 118. The third valve 84 has an external stem 182, which is used to actuate the third valve 84, and which is biased outwardly. The block 158 of the actuator 118, however, does not directly engage the external stem 182.

Such means 180 comprise a stepped, tubular structure 184, which is mounted upon the third valve 84, over the stem 182, by means of a bracket 186 and a nut 188, which is threaded onto a threaded portion 190 of the structure 184, as shown. A spool 192, which is axially movable within the tubular structure 184, is biased toward the stem 182 by means of a coiled spring 194. A pair of detent balls 196, which are biased, in radially inward directions, by means of a pair of coiled springs 198, which are held by set screws 200, coact with an annular groove 202 defined within the spool 192 so as to retain the spool 192 at a position where the spool 192 bears against the stem 182, but where the spool 192 does not displace the outwardly biased stem 182 by any significant amount. The spring 194 is deployed within the tubular structure 184, between the spool 192 and a button 204, which has an external stem 206, and which is retained within the tubular structure 184 (except for the external stem 206) by means of a cap 208 having a suitable aperture for the external stem 206. The spring 194 biases the stem 206 outwardly.

The block 158 of the actuator 118 is arranged so as to engage the outwardly biased stem 206 of the button 204, upon conjoint movement of the actuator 118 with the second control rod 114 over a distance approaching the distance correlating to a control dose, whereupon the button 204 is displaced so as to compress the coiled spring 194. When the button 204 engages the spool 192, the button 204 upon further movement dislodges the spool 192, so as to cam the balls 196 from the annular groove 202, onto the cylindrical surface of the spool 192, whereupon the spool 192 displaces the outwardly biased stem 182, so as to actuate the third valve 84 with a snap-action. The snap-action assures that the third valve 84 performs its desired functions and averts a situation wherein the first and second valves tend to be simultaneously open to air flow. When the actuator 118 is moved backwardly, that is, in the reverse direction, the spool 192, the detent balls 196, the coiled spring 194, and the button 204 are returned by means of the outwardly biased stem 182, which bears against the spool 192, to the positions at which they appear in FIG. 4.

Internal details of the fourth valve 86 are shown in FIG. 5. A ball 210, which serves as a valve closure, is biased against a valve seat 212 by means of a coiled spring 214. A rounded button 216, which is integrally carried upon an inner end of the stem 104, prevents the stem 104 from being pulled out of the valve 86. When the button 102 upon the stem 104 is manually depressed, the button 216 cams the ball 210 from the seat 212, whereby pressurized air entering the pneumatic mechanism 50 from the source 58 is diverted so as to exit through the seat 212. A hose 218 is connected to the valve 86, by means of a conventional coupling 220, so as to receive the pressurized air exiting through the seat 212. When the button 102 is released, the spring 214 returns the ball 210 onto the seat 212, and the ball 210 cams the button 216 so as to expel the stem 104 and the button 102 as far as the button 216 permits. A nozzle 222 is connected to the hose 218.

When the button 102 is manually depressed, whereby the fourth valve 86 is actuated, pressurized air passing through the hose 218, to the nozzle 222, can be readily directed by means of a user so as to blow water, debris, or both from a hole (not shown) bored of otherwise formed within a concrete or masonry structure, just before the mixed parts of an adhesive are injected into the hole by means of the adhesive dispenser 10. This is done so as to maximize the bonding capability of the adhesive in connection with the anchoring application.

As shown in FIGS. 13, 14, and 15, a cam 230 rotatably mounted upon an upper portion of the linking lever 140, as by means of a threaded pin 232 receiving a nut 234, may be alternatively substituted for the cam 150 mounted upon the upper mounting block 120 by means of the vertical pin 152. The cam 230 is selected so as to have a thickness approximately equal to the distance by which the upper mounting block 120 is offset with respect to the lower mounting block 42. The cam 230 is cylindrical, except for a flat surface 236, upon its cylindrical periphery, and except for knurling defined upon its cylindrical periphery. The flat surface 236 enables the cam 230 to clear the cover 170 (see FIG. 14) when it is desired to allow the linking lever 140 to pivot from a position at a right angle with respect to the first control rod 112 through the aforenated (non-right) angles (as large as approximately 10°) relative to the first control rod 112 and the second control rod 114 respectively. The cam 230 engages and is interposed between the linking lever 140 and adjacent structure provided by means of the upper mounting block 120 (see FIG. 15) when it is desired to position the linking lever 140 at right angles relative to the first control rod 112 and the second control rod 114 respectively.

Herein, directional terms, such as, for example, "downwardly", and "laterally", "upper", "lower", and terms of like import, refer to the dispenser 10 in a convenient orientation, in which the dispenser 10 appears in FIG. 1 and other views of the drawings, but are not intended to limit the dispenser provided by this invention to any particular orientation.

Other modifications may also be made to the adhesive dispenser provided by means of this invention without departing from the scope and spirit of this invention which are defined by means of the appended claims, and consequently, the in accordance with such claims, the present invention may be practiced otherwise than as specifically described herein.

We claim:

1. A pneumatically actuatable dispenser for an adhesive, as provided within a cartridge having a chamber containing said adhesive, said cartridge having a first end and a second end and having a nozzle mounted upon said first end, said chamber having a plunger accessible from said second end and displaceable through said chamber, toward said nozzle, so as to force said adhesive into said nozzle, through which said adhesive is ejected, said dispenser comprising:

(a) a frame adapted to hold said cartridge;

(b) a pneumatic mechanism connectable to a source of pressurized air and attached to said frame so as to support said frame with said cartridge held by said frame, said pneumatic mechanism including (i) a pneumatic cylinder fixed to said frame;

(ii) pneumatic piston means arranged to be pneumatically driven within said pneumatic cylinder by said pressurized air;

(iii) control means for selectively driving said pneumatic piston means within said pneumatic cylinder in either a forward direction or in a reverse direction by said pressurized air;

(iv) a piston rod extended from said pneumatic piston means, through one end of said pneumatic cylinder, and arranged to move conjointly with said pneumatic piston means, to drive said plunger of said cartridge held by said frame toward said nozzle when said pneumatic piston means is driven in said forward direction, and to withdraw from said plunger of said cartridge when said pneumatic piston means is driven in said reverse direction; and (c) means predeterminedly adjustable by means of a user and operatively connected to said piston means for actuating said pneumatic control means so as to predeterminedly limit said conjoint movement of said pneumatic piston means and said piston rod in said forward direction beyond a predetermined amount of travel of said pneumatic piston means and said piston rod so as to enable said dispenser to eject an adjustably controlled dose of said adhesive from said cartridge held by said frame.

2. A pneumatically actuatable dispenser as set forth in claim 1, wherein the pneumatic mechanism comprises:

(i) a manually actuatable valve arranged, when actuated manually with the pneumatic mechanism connected to the source of pressurized air, to divert pressurized air entering the pneumatic mechanism; and (ii) a hose connected to and arranged to receive pressurized air from the valve.

3. The dispenser of claim 2 wherein the pneumatic mechanism comprises a nozzle connected to the hose.

4. A dispenser as set forth in claim 1, wherein:

said pneumatic control means comprises a first fluid circuit for fluidically connecting said source of pressurized air to said pneumatic piston means so as to drive said pneumatic piston means in said forward direction, a first manually actuatable valve means for closing said first fluid circuit so as to permit said pressurized air to drive said pneumatic piston means in said forward direction, and a second valve means for opening said first fluid circuit so as to vent said pressurized air from said first fluid circuit and thereby prevent said pressurized air from driving said pneumatic piston means; and said actuating means comprises an actuator block adjustably mounted upon said piston means for engaging said second valve means of said pneumatic control means at a predetermined location of said travel of said pneumatic piston means so as to open said first fluid circuit and vent said pressurized air from said first fluid circuit.

5. A pneumatically actuatable dispenser for an adhesive, as provided in a cartridge having a chamber containing the adhesive, the cartridge having a first end and a second end and having a nozzle mounted to the first end, the chamber having a plunger accessible from the second end and displaceable through the chamber, toward the nozzle, so as to force the adhesive into the nozzle, through which the adhesive is ejected, the dispenser comprising:

(a) a frame adapted to hold such a cartridge;

(b) a pneumatic mechanism connectable to a source of pressurized air and attached to the frame so as to support the frame with such a cartridge held by the frame, the pneumatic mechanism comprising:

(i) a pneumatic cylinder affixed to the frame;

(ii) a pneumatic piston arranged to be pneumatically driven within the cylinder, selectively in a forward direction or in a reverse direction;

(iii) a piston rod extended from the pneumatic cylinder, through one end of the pneumatic cylinder, and arranged to move conjointly with the pneumatic piston, to drive the plunger of such a cartridge held by the frame toward the nozzle when the pneumatic piston is driven in a forward direction, and to withdraw from the plunger of the last-mentioned cartridge when the pneumatic piston is driven in the reverse direction; and (iv) pneumatic valves comprising (1) a manually actuatable first valve arranged, when actuated manually with the pneumatic mechanism connected to the source of pressurized air, to deliver pressurized air from the source to the pneumatic cylinder so as to drive the pneumatic piston in the forward direction;

(2) a manually actuatable second valve arranged, when actuated manually with the pneumatic mechanism connected to the source of pressurized air, to deliver pressurized air from the source to the pneumatic cylinder so as to drive the pneumatic piston in the reverse direction; and (3) a mechanically actuatable third valve arranged, when actuated mechanically while the first valve is actuated, to block pressurized air from flowing from the first valve into the pneumatic cylinder and simultaneously to vent pressurized air, as delivered previously by the first valve, from the pneumatic cylinder to ambient atmosphere; and (c) means adjustable by a user for limiting conjoint movement of the pneumatic piston and the piston rod in the forward direction so as to enable the dispenser to eject an adjustably controlled dose of an adhesive from such a cartridge held by the frame, the means comprising:

(i) a first control rod arranged to be conjointly driven with the pneumatic piston, along an exterior surface of such a cartridge held by the front frame, without interfering with the last-mentioned cartridge;

(ii) a second control rod arranged to be selectively linked to or unlinked from the first control rod so as to move conjointly with the first control rod, in parallel relation to the first control rod, when linked to the first control rod, and so as to be independently movable when unlinked from the first control rod;

(iii) means operable manually and selectively by a user to link the second control rod to the first control rod, at any position within a range of possible positions along the first control rod, or to unlink the second control rod from the first control rod;

(iv) an actuator positionable adjustably along the second control rod, at any position within a range of possible positions along the second control rod, for conjoint movement with the second control rod, the actuator being arranged to actuate the third valve upon conjoint movement of the first control rod, the second control rod, and the actuator from respective dose-initiating positions relative to the pneumatic cylinder, where the piston rod can begin to drive the plunger of such a cartridge held by the frame toward the nozzle of the last-mentioned cartridge, to respective dose-concluding positions relative to the pneumatic cylinder, where the plunger of the last-mentioned cartridge has been displaced by a distance correlating to a controlled dose of the adhesive from the last-mentioned cartridge;

whereby the actuator can be adjustably positioned along the second control rod so as to enable the dispenser, when the second control rod is linked to the first control rod, to eject a controlled dose of an adhesive from such a cartridge held by the frame with the last-mentioned dose being less than full contents of the last-mentioned cartridge.

6. The dispenser of claim 5 wherein the means operable manually and a user comprise a linking lever attached to one end of the second control rod so as to retain the linking lever on the end of the second control rod but to permit a limited range of pivotal movement of the linking lever on the end of the second control rod, the linking lever having an aperture, through which the first control rod extends with a loose fit allowing the first control rod to pass freely through aperture except when pivotal movement of the linking lever causes the linking lever frictionally to engage the first control, means for biasing the second control rod in the reverse direction, and means operable manually by a user to position the linking lever selectively in a pivotal position permitting the first control rod to pass freely through the aperture or in a pivotal position causing the linking lever frictionally to engage the first control rod as mentioned.

7. The dispenser of claim 6 wherein the means operable manually by a user to position the linking lever comprises a cam mounted operatively in fixed relation to the pneumatic cylinder and arranged to be manually adjusted between a condition wherein the cam engages and is interposed between the linking lever and adjacent structure so as to position the linking means in the pivotal position permitting the first control rod to pass freely through the aperture and a condition wherein the cam permits the means for biasing the second control rod in the rearward direction to pivot the linking lever, by means of the second control rod, to the pivotal position causing the linking lever frictionally to engage the first control rod as mentioned.

8. The dispenser of claim 6 wherein the means operable manually by a user to position the linking lever comprises a cam mounted operatively to the linking lever and arranged to be manually adjusted between a condition wherein the cam engages and is interposed between the linking lever and adjacent structure so as to position the linking means in the pivotal position permitting the first control rod to pass freely through the aperture and a condition wherein the cam permits the means for biasing the second control rod in the rearward direction to pivot the linking lever, by means of the second control rod, to the pivotal position causing the linking lever frictionally to engage the first control rod as mentioned.

9. The dispenser of claim 5 wherein the pneumatic mechanism comprises a manually actuated fourth valve arranged, when actuated manually with the pneumatic mechanism connected to the source of pressurized air, to divert pressurized air entering the pneumatic mechanism, along with a hose connected to and arranged to receive pressurized air from the fourth valve.

10. The dispenser of claim 9 wherein the pneumatic mechanism comprises a nozzle connected to the hose.

11. A pneumatically actuatable dispenser for a two-part adhesive, as provided within a cartridge having two chambers, each containing one of two parts of said adhesive, said cartridge having a first end and a second end, and a mixing nozzle mounted upon said first end and arranged to receive one of said parts of said adhesive from each chamber and to mix said parts together, each chamber having a plunger accessible from said second end and displaceable through said chamber, toward said nozzle, in which said parts of said adhesive are mixed, and through which said mixed parts of said adhesive are ejected, said dispenser comprising:

(a) a frame adapted to hold said cartridge;

(b) a pneumatic mechanism connectable to a source of pressurized air and attached to said frame so as to support said frame with said cartridge held by said frame, said pneumatic mechanism including (i) a pneumatic cylinder fixed to said frame;

(ii) pneumatic piston means arranged to be pneumatically driven within said pneumatic cylinder by said pressurized air;

(iii) control means for selectively driving said pneumatic piston means within said pneumatic cylinder in either a forward direction or in a reverse direction by said pressurized air;

(iv) a pair of piston rods operable in tandem, extended through one end of said pneumatic cylinder, and arranged to move conjointly with said pneumatic piston means, each piston rod being arranged to drive said plunger of a respective one of said chambers of said cartridge held by said frame toward said nozzle of said cartridge when said pneumatic piston mean sis driven in said forward direction, each piston rod being arranged to withdraw from said plunger when said pneumatic piston means is driven in said reverse direction; and (c) means predeterminedly adjustable by means of a user and operatively connected to said piston means for actuating said pneumatic control means so as to predeterminedly limit said conjoint movement of said pneumatic piston means and each piston rod in said forward direction beyond a predetermined amount of travel of said pneumatic piston means and said piston rods so as to enable said dispenser to eject an adjustably controlled dose of said mixed parts of said adhesive from said cartridge held by said frame.

12. A dispenser as set forth in claim 11, wherein:

said pneumatic control means comprises a first fluid circuit for fluidically connecting said source of pressurized air to said pneumatic piston means so as to drive said pneumatic piston means in said forward direction, a first manually actuatable valve means for closing said first fluid circuit so as to permit said pressurized air to drive said pneumatic piston mean sin said forward direction, and a second valve means for opening said first fluid circuit so as to vent said pressurized air from said first fluid circuit and thereby prevent said pressurized air from driving said pneumatic piston means; and said actuating means comprises an actuator block adjustably mounted upon said pneumatic piston means for engaging said second valve means of said pneumatic control means at a predetermined location of said travel of said pneumatic piston means so as to open said first fluid circuit and vent said pressurized air from said first fluid circuit.

13. A dispenser as set forth in claim 11, wherein said pneumatic mechanism comprises:

a manually actuatable valve arranged, when actuated manually with said pneumatic mechanism connected to said source of pressurized air, to divert said pressurized air entering said pneumatic mechanism; and a hose connected to and arranged to receive pressurized air from said valve.

14. A dispenser as set forth in claim 13, wherein:

said pneumatic mechanism further comprises a nozzle connected to said hose.

15. A pneumatically actuatable dispenser for a two-part adhesive, as provided in a cartridge having two chambers, each containing one of two parts of the adhesive, the cartridge having a first end and a second end, having a mixing nozzle mounted to the first end and arranged to receive one part of the adhesive from each chamber and to mix such parts, each chamber having a plunger accessible from the second end and displaceable through such chamber, toward the nozzle, in which the parts of the adhesive are mixed, and through which the mixed parts of the adhesive are ejected, the dispenser comprising:

(a) a frame adapted to hold such a cartridge;

(b) a pneumatic mechanism connectable to a source of pressurized air and attached to the frame so as to support the frame with such a cartridge held by the frame, the pneumatic mechanism comprising:
(i) a pneumatic cylinder affixed to the frame;
(ii) a pneumatic piston arranged to be pneumatically driven within the cylinder, selectively in a forward direction or in a reverse direction;
(iii) a pair of piston rods operable in tandem, extended through one end of the pneumatic cylinder, and arranged to move conjointly with the pneumatic piston, each piston rod being arranged to drive the plunger of a respective one of the chambers of such a cartridge held by the frame toward the nozzle of the last-mentioned cartridge when the pneumatic piston is driven in a forward direction, each piston rod being arranged to withdraw from the last-mentioned plunger when the pneumatic piston is driven in the reverse direction;
(iv) pneumatic valves comprising:
(1) a manually actuatable first valve arranged, when actuated manually with the pneumatic mechanism connected to a source of pressurized air, to deliver pressurized air from the source to the pneumatic cylinder so as to drive the pneumatic piston in the forward direction;
(2) a manually actuatable second valve arranged, when actuated manually with the pneumatic mechanism connected to a source of pressurized air, to deliver pressurized air from the source to the pneumatic cylinder so as to drive the pneumatic piston in the reverse direction; and
(3) a mechanically actuatable third valve arranged, when actuated mechanically while the first valve is actuated, to block pressurized air from flowing from the first valve into the pneumatic cylinder and simultaneously to vent pressurized air, as delivered previously by the first valve, from the pneumatic cylinder to ambient atmosphere; and (c) means adjustable by a user for limiting conjoint movement of the pneumatic piston and each piston rod in the forward direction so as to enable the dispenser to eject an adjustably controlled dose of the mixed parts of an adhesive from such a cartridge held by the frame, the means comprising:
(i) a first control rod arranged to be conjointly driven with the pneumatic piston, along an exterior surface of such a cartridge held by the frame, without interfering with the last-mentioned cartridge;
(ii) a second control rod arranged to be selectively linked to or unlinked from the first control rod so as to move conjointly with the first control rod, in parallel relation to the first control rod, when linked to the first control rod, and so as to be independently movable when unlinked from the first control rod;
(iii) means operable manually and selectively by a user to link the second control rod to the first control rod, at any position within a range of possible positions along the first control rod, or to unlink the second control rod from the first control rod;
(iv) an actuator positionable adjustably along the second control rod, at any position within a range of possible positions along the second control rod, for conjoint movement with the second control rod, the actuator being arranged to actuate the third valve upon conjoint movement of the first control rod, the second control rod, and the actuator from respective dose-initiating positions relative to the pneumatic cylinder, where the piston rods can begin to drive the plungers of such a cartridge held by the frame toward the nozzle of the last-mentioned cartridge, to respective dose-concluding positions relative to the pneumatic cylinder, where the plungers of the last-mentioned cartridge have been displaced by a distance correlating to a controlled dose of the mixed parts of the adhesive from the last-mentioned cartridge;

whereby the actuator can be adjustably positioned along the second control rod so as to enable the dispenser, when the second control rod is linked to the first control rod, to eject a controlled dose of the mixed parts of an adhesive from such a cartridge held by the frame with the last-mentioned dose being less than full contents of the last-mentioned cartridge.

16. The dispenser of claim 15 wherein the means operable manually and selectively by a user comprises a linking lever attached to one end of the second control rod so as to retain the linking lever on the end of the second control rod but to permit a limited range of pivotal movement of the linking lever on the end of the second control rod, the linking lever having an aperture, through which the first control rod extends with a loose fit allowing the first control rod to pass freely through the aperture except when pivotal movement of the linking lever causes the linking lever frictionally to engage the first control rod, means for biasing the second control rod in the rearward direction, and means operable manually by a user to position the linking lever selectively in a pivotal position permitting the first control rod to pass freely through the aperture or in a pivotal position causing the linking lever frictionally to engage the first control rod as mentioned.

17. The dispenser of claim 16 wherein the means operable manually by a user to position the linking lever comprises a cam mounted operatively in fixed relation to the pneumatic cylinder and arranged to be manually adjusted between a condition wherein the cam engages and is interposed between the linking lever and adjacent structure so as to position the linking means in the pivotal position permitting the first control rod to pass freely through the aperture and a condition wherein the cam permits the means for biasing the second control rod in the rearward direction to pivot the linking lever, by means of the second control rod, to a pivotal position causing the linking lever frictionally to engage the first control rod as mentioned.

18. The dispenser of claim 16 wherein the means operable manually by a user to position the linking lever comprises a cam mounted operatively to the linking lever and arranged to be manually adjusted between a condition wherein the cam engages and is interposed between the linking lever and adjacent structure so as to position the linking means in the pivotal position permitting the first control rod to pass freely through the aperture and a condition wherein the cam permits the means for biasing the second control rod in the rearward direction to pivot the linking lever, by means of the second control rod, to a pivotal position causing the linking lever frictionally to engage the first control rod as mentioned.

19. The dispenser of claim 15 wherein the pneumatic mechanism comprises a manually actuatable fourth valve arranged, when actuated manually with the pneumatic mechanism connected to the source of pressurized air, to divert pressurized air entering the pneumatic mechanism, along with a hose connected to and arranged to receive pressurized air from the fourth valve.

20. The dispenser of claim 19 wherein the pneumatic mechanism comprises a nozzle connected to the hose.

* * * * *